US009481965B2

(12) United States Patent
Schuette

(10) Patent No.: US 9,481,965 B2
(45) Date of Patent: Nov. 1, 2016

(54) SYSTEM FOR ABSORBING IMPACT LOAD IN A MACHINE

(71) Applicant: Caterpillar Paving Products Inc., Brooklyn Park, MN (US)

(72) Inventor: Ryan J. Schuette, St. Michael, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 39 days.

(21) Appl. No.: 14/612,551

(22) Filed: Feb. 3, 2015

(65) Prior Publication Data

US 2016/0222604 A1 Aug. 4, 2016

(51) Int. Cl.
*E01C 19/48* (2006.01)

(52) U.S. Cl.
CPC ..... *E01C 19/48* (2013.01); *E01C 2301/08* (2013.01)

(58) Field of Classification Search
CPC ..... E01C 19/48
USPC ..... 293/118, 102; 404/108
See application file for complete search history.

(56) References Cited

U.S. PATENT DOCUMENTS 3,990,721 A * 11/1976 Hoffman ..... B60D 3/00 180/14.1
4,955,754 A 9/1990 Smith
8,827,592 B2 9/2014 Frelich et al.

* cited by examiner

*Primary Examiner* — Joseph D Pape

(57) ABSTRACT

A system associated with a machine is provided. The system is configured to engage with a vehicle. The system includes a first frame and a second frame to support a first roller and a second roller, respectively. The first roller and the second roller are configured to abut a first and a second set of ground engaging members, respectively, of the vehicle. The system further includes a pin member to couple the first frame and the second frame. The first frame and the second frame are moveable relative to each other about a rotating axis defined by the pin member. The system further includes an actuating member coupled between the first frame and the second frame. The actuating member is configured to move the first frame and the second frame about the pin member.

20 Claims, 6 Drawing Sheets

SYSTEM FOR ABSORBING IMPACT LOAD IN A MACHINE

TECHNICAL FIELD

The present disclosure relates to a system for absorbing impact load in a paving machine.

BACKGROUND

During paving operations, trucks having different sizes and shapes deliver paving material to paving machines for application on road or other surfaces. The truck typically back up towards the paving machine such that the truck operator may tilt the truck's bed into a position to unload paving material into a receptacle of the paving machine. The paving machine includes a push-roller system that is attached close to an end of the receptacle. When the paving machine is set up correctly, the tires of the truck will contact the push-roller system and maintain a proper distance for its bed to unload material into the receptacle. Some push-roller systems require manual adjustments to accommodate trucks of different shapes and sizes, which lead to increased complexity and duration of unloading. Further, some powered push-roller systems require resetting after every engagement of the truck with the machine.

U.S. Pat. No. 8,827,592 (the '592 patent) discloses a machine having a chassis and a push-roller assembly connected to the chassis. The push-roller assembly engages a vehicle and includes a support frame with rollers, and support arms with a chassis end connected to the support frame and a linkage end connected to the chassis. The support frame moves relative to the chassis when the support arm pivots with respect to the chassis and the support frame. The machine further includes an actuator controller associated with an actuator in the push-roller assembly. The actuator is connected to the support arm, causing the support arm to pivot with respect to the chassis and support frame, and displacing the support frame relative to the chassis. The '592 patent discloses various mechanical linkages for the push-roller assembly, thereby resulting in an increase in design and manufacturing complexity. Further, adding the actuator controller for automation of operation of the push-roller assembly may increase cost.

SUMMARY OF THE DISCLOSURE

In one aspect of the present disclosure, a system for absorbing impact load in a machine is provided. The impact load is caused by a vehicle. The system includes a first frame adapted to support a first roller. The first roller is configured to abut a first set of ground engaging members of the vehicle. The system further includes a second frame adapted to support a second roller. The second roller is configured to abut a second set of ground engaging members of the vehicle. The system further includes a pin member configured to couple the first frame and the second frame. The first frame and the second frame are configured to be moveable relative to each other about a rotating axis defined by the pin member. The system further includes an actuating member coupled between the first frame and the second frame. The actuating member is configured to move the first frame and the second frame about the pin member.

In another aspect of the present disclosure, a machine is provided. The machine includes a chassis and a system associated with the chassis. The system is configured to absorb the impact load caused by a vehicle. The system includes a first frame adapted to support a first roller. The first roller is configured to abut a first set of ground engaging members of the vehicle. The system further includes a second frame adapted to support a second roller. The second roller is configured to abut a second set of ground engaging members of the vehicle. The system further includes a pin member configured to couple the first frame and the second frame. The first frame and the second frame are configured to be moveable relative to each other about a rotating axis defined by the pin member. The pin member is coupled to the chassis of the machine. The system further includes an actuating member coupled between the first frame and the second frame. The actuating member is configured to move the first frame and the second frame about the pin member.

In yet another aspect of the present disclosure, a system for absorbing impact load in a machine is provided. The impact load is caused by a vehicle. The system includes a first frame having a first end adapted to support a first roller. The first roller is configured to abut a first set of ground engaging members of the vehicle. The first frame includes a first arm at a second end thereof. The second end is distal from the first end. The system includes a second frame adapted to support a second roller. The second roller is configured to abut a second set of ground engaging members of the vehicle. The second frame includes a second arm at a second end thereof. The second end is distal from the first end. The system further includes a pin member configured to couple the second ends of the first frame and the second frame. The first frame and the second frame are configured to be moveable relative to each other about a rotating axis defined by the pin member. The system further includes an actuating member configured to move the first frame and the second frame about the pin member. The actuating member includes a cylinder having a head end coupled to one of the first arm and the second arm. The actuating member further includes a plunger slidably received within the cylinder through a rod end thereof. The plunger has a free end coupled to one of the first arm and the second arm. The plunger is configured to be movable between an extended position and a retracted position to move the first frame and the second frame about the pin member.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
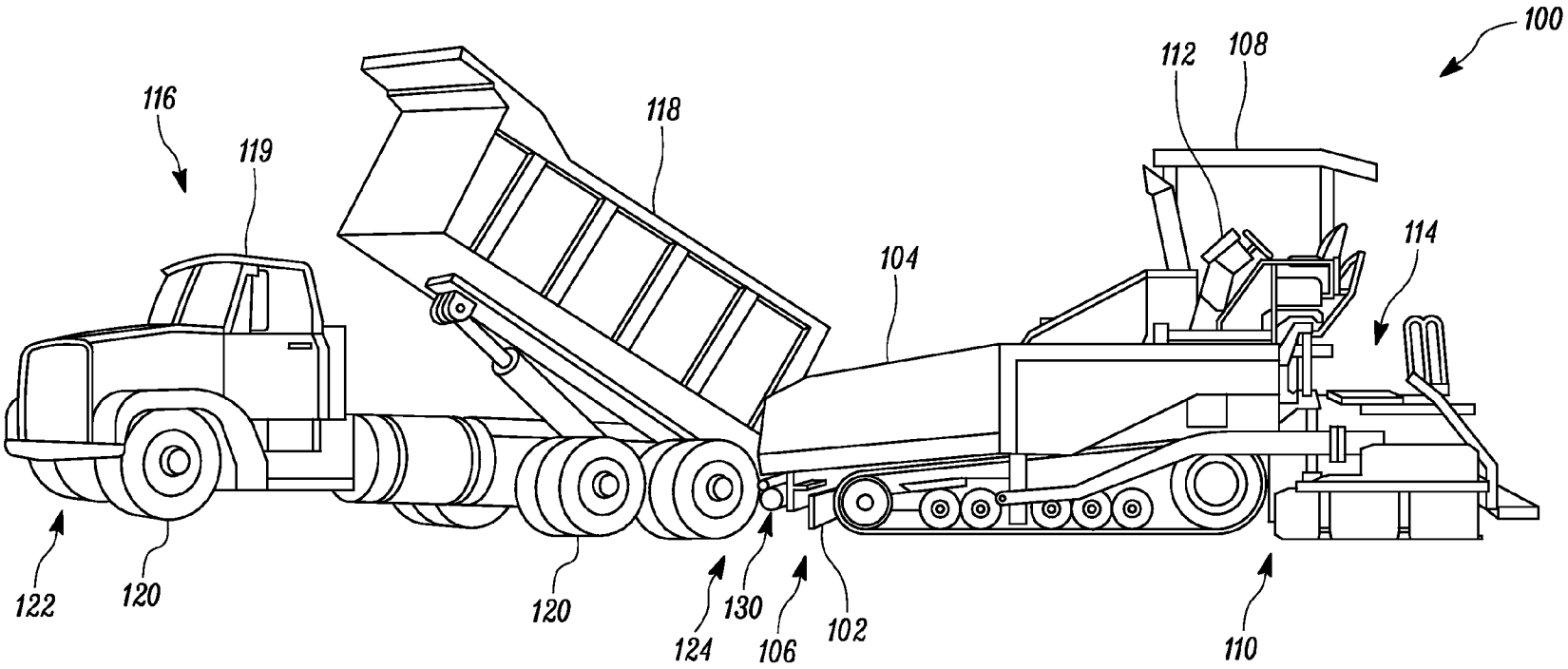
FIG. 1 is a view of a machine having a system for absorbing impact load, according to an embodiment of the present disclosure, and a vehicle positioned adjacent to the machine during a material transfer process.

FIG. 1 shows a side view of an exemplary machine 100. In the illustrated embodiment, the machine 100 is a paving machine used in various applications to apply a material, such as asphalt, on roadways or other surfaces. The machine 100 includes a chassis 102 adapted to support various components including, but not limited to, a hopper 104, an operator station 108 and a screed assembly 114. The hopper 104 may be disposed adjacent to a front end 106 of the machine 100. The hopper 104 may be configured to contain the material required to be applied on the roadways or other surfaces. The operator station 108 may be disposed adjacent to a rear end 110 of the machine 100. The operator station 108 includes a control console 112 used by a machine operator to control various operations, such as paving operation of the machine 100. The screed assembly 114 may be disposed at the rear end 110 of the machine 100. The screed assembly 114 may be configured to receive the material from the hopper 104 and deposit the material on a work surface.

Referring further to FIG. 1, a vehicle 116 is shown at the front end 106 of the machine 100. The vehicle 116 includes a bed 118 to carry the material and to unload the material at a desired location. The bed 118 may be operated by one or more control levers disposed in an operator cab 119 of the vehicle 116. The vehicle 116 further includes ground engaging members 120 adjacent to a front end 122 and a rear end 124 thereof. In the illustrated embodiment, the ground engaging members 120 includes wheels. In other embodiments, the ground engaging members 120 may be track assemblies. Specifically, the vehicle 116 includes a first set of the ground engaging members 120A (shown in FIG. 5) and a second set of the ground engaging members 120B (shown in FIG. 5) disposed at each side of the vehicle 116 adjacent to the rear end 124.

The machine 100 further includes a system 130 disposed at the front end 106 of the machine 100 for absorbing impact load caused by the vehicle 116. In the illustrated embodiment, the system 130 is a push-roller assembly. For illustration purpose, the system 130 hereinafter referred as 'the push-roller assembly 130'. The push-roller assembly 130 is coupled to the chassis 102 of the machine 100. The push-roller assembly 130 is configured to abut the ground engaging members 120 of the vehicle 116 during paving operation. Further, the push-roller assembly 130 is configured to provide a smooth engagement of the vehicle 116 with the machine 100 during paving operation.

During paving operation, the vehicle 116 may be positioned adjacent to the front end 106 of the machine 100 such that the bed 118 is positioned adjacent to the hopper 104. This requires the vehicle 116 to back up to the machine 100 until the ground engaging members 120 at the rear end 124 of the vehicle 116 abut the push-roller assembly 130. Further, the bed 118 may be raised to deposit the material in the hopper 104. The material may be deposited in the hopper 104 gradually as the machine 100 moves, while pushing the vehicle 116, along the work surface to be paved.

Figure 2:
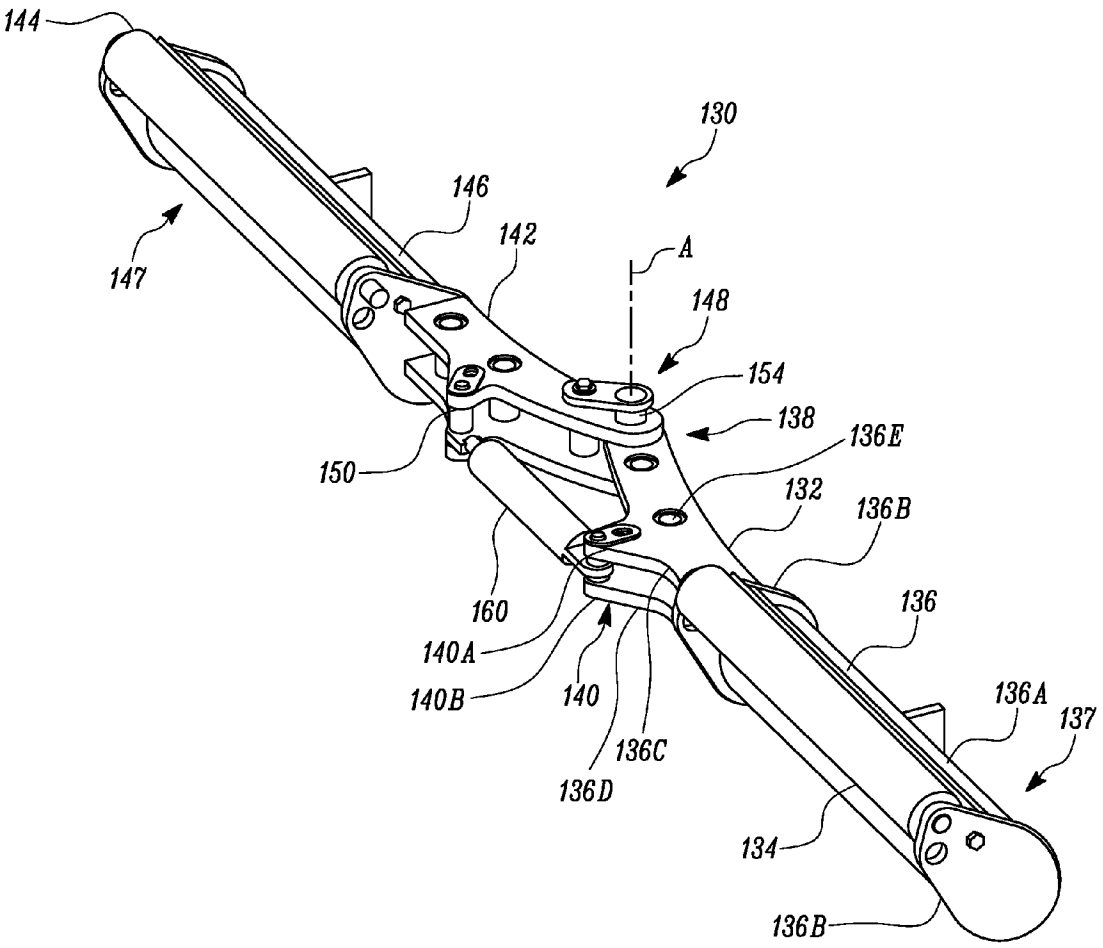
FIG. 2 is a perspective view of the system of FIG. 1, according to an embodiment of the present disclosure.

FIG. 2 shows a perspective view of the push-roller assembly 130, according to an embodiment of the present disclosure. The push-roller assembly 130 includes a first frame 132 adapted to support a first roller 134. The first roller 134 is configured to abut the first set of ground engaging members 120A of the vehicle 116 during paving operation. The first roller 134 may be a cylindrical body rotatably disposed on the first frame 132. The first roller 134 may have an outer surface adapted to rotatably engage with the first set of ground engaging members 120A of the vehicle 116 during the paving operation.

The first frame 132 includes an elongate body 136 having a first end 137 adapted to support the first roller 134 and a second end 138 distal to the first end 137. In an exemplary embodiment, the elongate body 136 may include a cylindrical body 136A adjacent to the first end 137 to support the first roller 134. Each end of the cylindrical body 136A may include a coupling member 136B for rotatably coupling with the first roller 134. The elongate body may further include a first member 136C and a second member 136D distal to the first member 136C. The first and the second members 136C, 136D may be connected each other by a plurality of connecting members 136E. Although the elongate body 136 of the first frame 132 is illustrated as including the cylindrical body 136A and the first and the second members 136C, 136D, it may be contemplated that the elongate body 136 may have any alternate configuration.

The first frame 132 further includes a first arm 140 disposed adjacent to the second end 138 of the elongate body 136. In an exemplary embodiment, the first member 136C may include a first arm member 140A and the second member 136D may include a second arm member 140B. The first and the second arm members 140A, 140B together may define the first arm 140. In an embodiment, the first arm 140 may be integrally formed with the elongate body 136 of the first frame 132. In an alternative embodiment, the first arm 140 may be a separate part attached to the elongate body 136 of the first frame 132.

The push-roller assembly 130 further includes a second frame 142 adapted to support a second roller 144. The second roller 144 is configured to abut the second set of ground engaging members 120B during paving operation. The second roller 144, similar to the first roller 134, is adapted to rotatably engage with the second set of ground engaging members 120B of the vehicle 116 during the paving operation.

Similar to the first frame 132, the second frame 142 includes an elongate body 146 having a first end 147 adapted to support the second roller 144 and a second end 148 distal to the first end 147. The elongate body 146 may have a design similar to the elongate body 136. The second frame 142 further includes a second arm 150 disposed adjacent to the second end 148 of the elongate body 146. Similar to the first arm 140, the second arm 150 may be either integrally formed with the elongate body 146 or separately attached to the elongate body 146.

The push-roller assembly 130 further includes a pin member 154 configured to couple the first frame 132 and the second frame 142. The pin member 154 is adapted to pivotally couple the second ends 138, 148 of the first and the second frames 132, 142, respectively. Hence, the first and the second frames 132, 142 are configured to be moveable relative to each other about a rotating axis 'A' defined by the pin member 154. The push-roller assembly 130 further includes an actuating member 160 coupled between the first frame 132 and the second frame 142. The actuating member 160 is configured to move the first frame 132 and the second frame 142 about the pin member 154.

Figure 3:
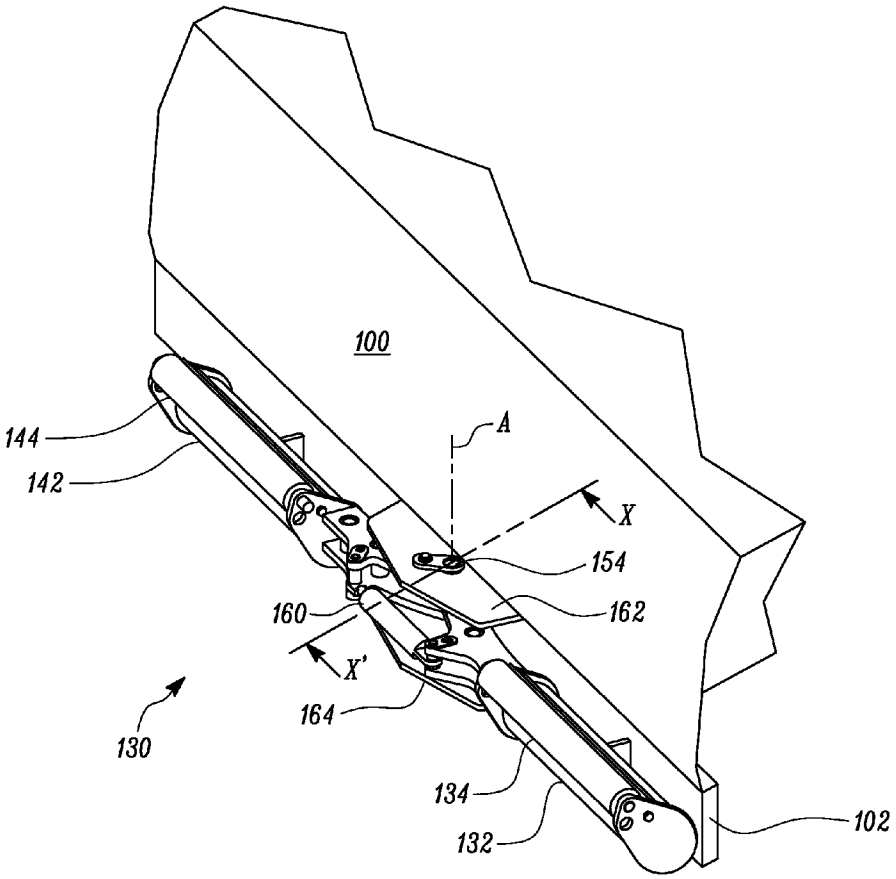
FIG. 3 is a perspective view of the system associated with a chassis of the machine, according to an embodiment of the present disclosure.
Figure 4:
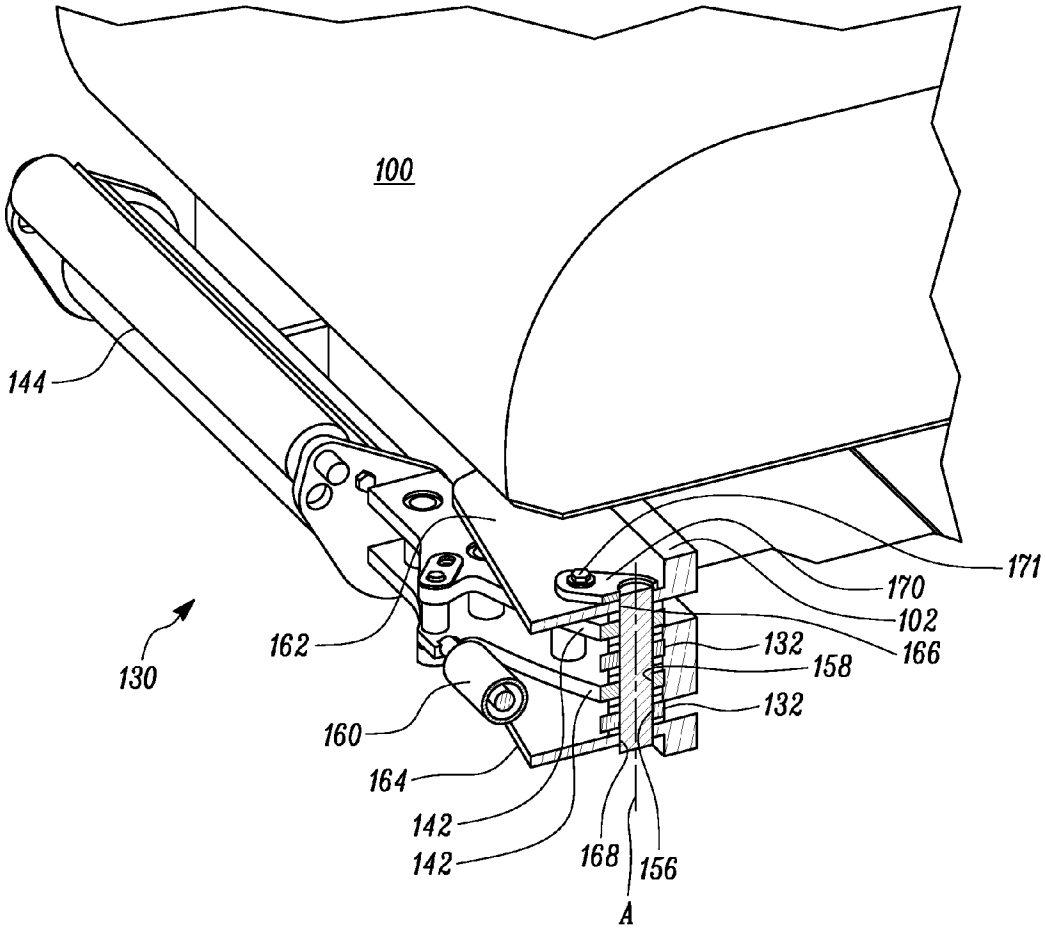
FIG. 4 is a sectional view taken along line X-X' of FIG. 3, according to an embodiment of the present disclosure.

FIG. 3 is a perspective view of the push-roller assembly 130 coupled to the chassis 102 of the machine 100, according to an embodiment of the present disclosure. FIG. 4 shows a sectional view taken along line X-X' of FIG. 3. Referring to FIGS. 3 and 4, the chassis 102 includes a first support member 162 and a second support member 164 distal to the first support member 162. The first and the second support members 162, 164 may extend horizontally from the chassis 102 and configured to receive the second ends 138, 148 of the first and the second frames 132, 142 therebetween. The first support member 162 includes a first aperture 166 defined along the rotating axis 'A'. The first aperture 166 is configured to at least partly receive the pin member 154 therethrough. The second support member 164 includes a second aperture 168 defined along the rotating axis 'A'. The second aperture 168 is configured to at least partly receive the pin member 154 therethrough.

The second end 138 of the first frame 132 includes a through hole 156 defined along the rotating axis 'A'. Similarly, the second end 148 of the second frame 142 includes a through hole 158 defined along the rotating axis 'A'. Further, the through holes 156, 158 may be aligned each other along the rotating axis 'A' to receive the pin member 154, such that the first and the second frames 132, 142 may be rotatable about the pin member 154.

In the illustrated embodiment, the pin member 154 may include a locking member 170 at one end thereof. The locking member 170 may be used for locking the pin member 154 with the first support member 162 of the chassis 102. Further, the locking member 170 may be configured to arrest axial and rotational movement of the pin member 154 along the rotating axis 'A'. The locking member 170 is coupled to the first support member 162 via fasteners 171, such as bolts.

During assembly of the push-roller assembly 130 with the machine 100, the second ends 138, 148 of the first and the second frames 132, 142 may be disposed between the first and the second support members 162, 164. The through holes 156, 158 of the first and the second frames 132, 142, respectively, may be aligned along the rotating axis 'A'. Further, the through holes 156, 158 may be further aligned with the first and the second apertures 166, 168 along the rotating axis 'A'. The pin member 154 may be further inserted through the first aperture 166, the through holes 156, 158 and the second aperture 168 to pivotally couple the push-roller assembly 130 with the chassis 102 of the machine 100. The locking member 170 of the pin member 154 may be further coupled with the first support member 162 to arrest axial and rotational movement of the pin member 154.

Figure 5:
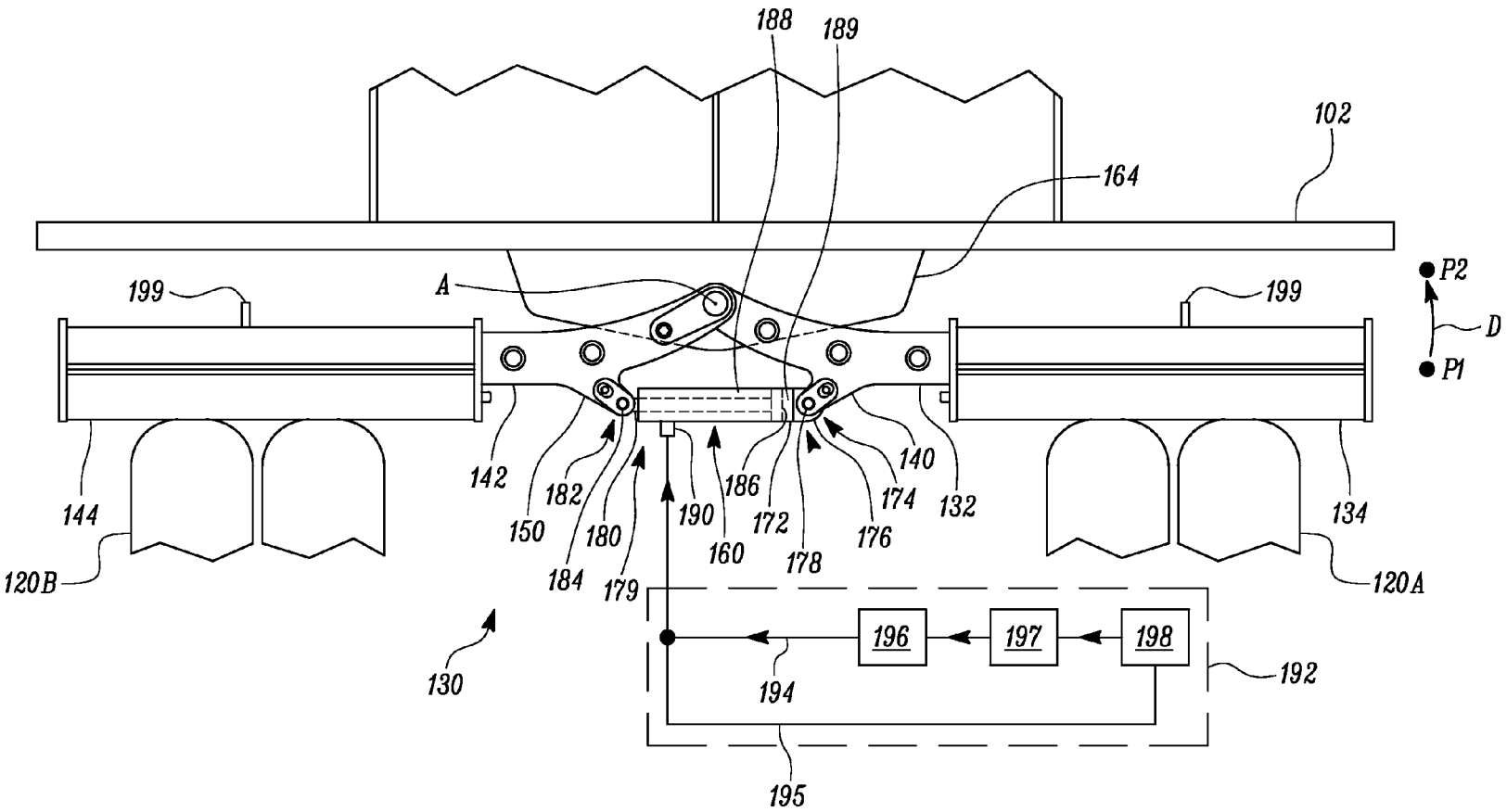
FIG. 5 is a top view of the system showing a first position thereof relative to the chassis, according to an embodiment of the present disclosure.

FIG. 5 is a top view of the push-roller assembly 130, according to an embodiment of the present disclosure. The actuating member 160 normally biases the first and the second rollers 134, 144 to a first position 'P1', as shown in FIG. 5. The first and the second frames 132, 142 may further move, along a direction 'D', towards the chassis 102 as the vehicle 116 engages with the machine 100 during paving operation. The pin member 154 facilitates such rotational movement of the first and second frames 132, 142. The first and the second rollers 134, 144, coupled to the first and the second frames 132, 142, respectively, may also move to a second position 'P2' along the direction 'D'. Further, one or more stopping members 199 may be attached to the first and the second frames 132, 142 to restrict movement of the first and the second rollers 134, 144 to the second position 'P2' in the direction 'D'.

In an embodiment, the actuating member 160 includes a cylinder 172 having a head end 174 coupled to the first arm 140 of the first frame 132. A coupling member 176 provided at the head end 174 of the cylinder 172 is pivotally coupled to the first arm 140 via a first fastening member 178. The cylinder 172 extends between the head end 174 and a rod end 179. The actuating member 160 further includes a plunger 180 slidably received within the cylinder 172 through the rod end 179. The plunger 180 has a free end 182 coupled to the second arm 150 of the second frame 142 via a second fastening member 184. It may also be contemplated that the head end 174 of the cylinder 172 may be coupled to the second arm 150 and the free end 182 of the plunger 180 may be coupled to the first arm 140. The plunger 180 is further configured to be movable between an extended position and a retracted position within the cylinder 172 to move the first frame 132 and the second frame 142 about the pin member 154 between the first position 'P1' and the second position 'P2'. The retracted position of the plunger 180 may correspond to the first position 'P1' and the extended position of the plunger 180 may correspond to the second position 'P2' of the first and the second rollers 134, 144.

In the illustrated embodiment, the actuating member 160 is a hydraulic actuator. The cylinder 172 includes a piston member 186 slidably disposed therein. Further, the piston member 186 may be disposed within the cylinder 172 in a fluid tight connection to define a first chamber 188 adjacent to the rod end 179 and a second chamber 189 adjacent to the head end 174. The piston member 186 is further coupled to the plunger 180. The cylinder 172 further includes a port 190 adjacent to the rod end 179 thereof. The port 190 is fluidly coupled to a hydraulic system 192 of the machine 100 via a fluid line 194. Thus, the actuating member 160 is configured to be in communication with the hydraulic system 192 of the machine 100.

The hydraulic system 192 includes an accumulator 196. The accumulator 196 may be configured to store a fluid at a desired pressure with the aid of an external device (not shown), such as a spring or a compressed gas. The accumulator 196 is configured to be in communication between the actuating member 160 and a reservoir 198. Specifically, the accumulator 196 is fluidly coupled to the port 190 of the cylinder 172. The reservoir 198 may be configured to contain hydraulic fluid therein. The accumulator 196 is in fluid communication with the first chamber 188 within the cylinder 172. The port 190 may also be in fluid communication with the reservoir 198 via another fluid line 195.

The hydraulic system 192 further includes a valve member 197 fluidly coupled between the accumulator 196 and the reservoir 198. The valve member 197 may be a pressure relief valve. The valve member 197 may be configured to selectively supply hydraulic fluid to the accumulator 196 to store the hydraulic fluid at a predefined pressure. The accumulator 196 is further configured to maintain a fluid pressure within the first chamber 188 substantially constant at the predefined pressure in the retracted position of the plunger 180. The pressure of hydraulic fluid within the first chamber 188 may be determined based on various parameters including, but not limited to, a load of the vehicle 116 and a desired rate at which the first frame 132 and the second frame 142 may move between the first position 'P1' and the second position 'P2' to absorb an impact load caused by engagement of the vehicle 116 with the machine 100.

In an exemplary embodiment, the hydraulic system 192 may include a pump (not shown) disposed between the reservoir 198 and the accumulator 196 to supply hydraulic fluid to the accumulator 196. The pump may receive power from an engine (not shown) of the machine 100. One or more direction control valves (not shown) may be disposed in the fluid line 194 between the pump and the accumulator 196 to control flow of hydraulic fluid to the accumulator 196 from the pump. Further, one or more direction control valves and/or pressure relief valves may be disposed between the accumulator 196 and the actuating member 160 to allow flow of hydraulic fluid from the first chamber 188 of the cylinder 172 to the reservoir 198 during movement of the plunger 180 to the extended position thereof. It may be contemplated that the pump and the reservoir 198 may be part of other hydraulic systems used for operating various systems of the machine 100 such as, a steering system, an implement system and systems used for paving operation of the machine 100.

Referring to FIG. 5, the retracted position of the plunger 180 corresponding to the first position 'P1' of the first and the second rollers 134, 144 is illustrated in detail. During movement of the plunger 180 to the retracted position, the first chamber 188 in the cylinder 172 may be in fluid communication with the accumulator 196 via the port 190. Upon actuation of the pump, hydraulic fluid may be supplied to the accumulator 196 from the reservoir 198. The accumulator 196 may receive hydraulic fluid from the pump and further supply hydraulic fluid to the first chamber 188. The accumulator 196 may continue to receive hydraulic fluid from the pump till pressure of hydraulic fluid within the first chamber 188 reaches the predefined pressure. After reaching the predefined pressure within the first chamber 188, the supply of hydraulic fluid from the pump may be directed back to the reservoir 198 through the direction control valves and/or pressure relieve valves. Thus, the first and the second rollers 134, 144 of the first and the second frames 132, 142 may be normally positioned at the first position 'P1'.

In the illustrated embodiment, the actuating member 160 is a single acting cylinder biased by the hydraulic system 192. However, in another embodiment, the actuating member 160 may be a single acting cylinder biased by a resilient member, such as a spring. In yet another embodiment, the actuating member 160 may be a double acting cylinder.

INDUSTRIAL APPLICABILITY

The present disclosure relates to the system 130 for providing smooth engagement of the vehicle 116 with the machine 100 during paving operation. The actuating member 160 of the system 130 communicated with the hydraulic system 192 may absorb impact loads by moving the first and the second rollers 134, 144 about the pin member 154 while maintaining the pressure within the cylinder 172 substantially constant at the predefined pressure.

Figure 6:
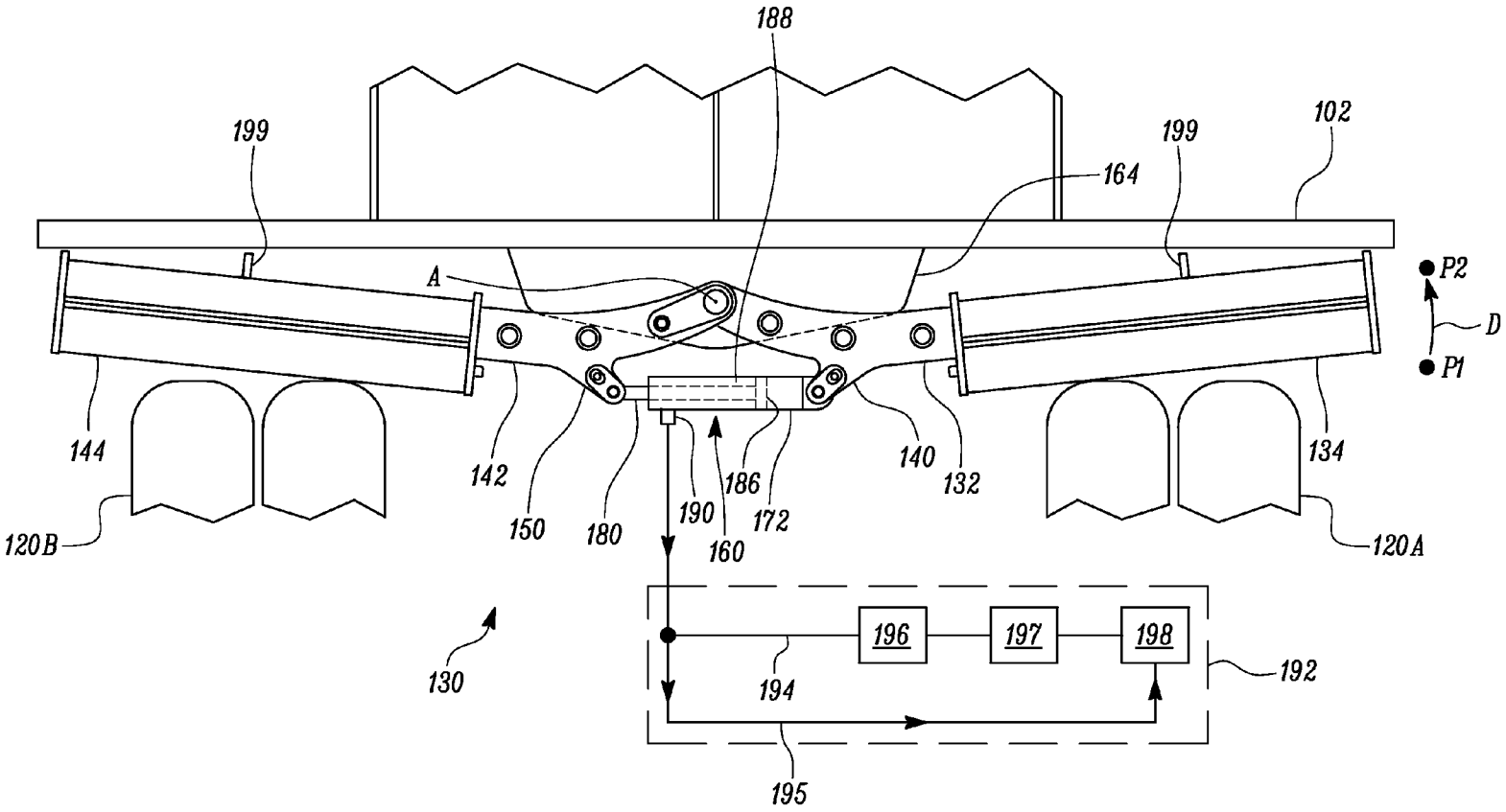
FIG. 6 is a top view of the system showing a second position thereof relative to the chassis during a paving operation, according to an embodiment of the present disclosure.

Referring to FIG. 6, as the first and the second set of ground engaging member 120A, 120B of the vehicle 116 engage with the first and the second rollers 134, 144, the first and the second frames 132, 142 move along the direction 'D' from the first position 'P1'. Consequently, the plunger 180 along with the piston member 186 moves to the extended position. Thus, hydraulic fluid stored in the first chamber 188 may flow to the reservoir 198 via the port 190. However, the pressure within the cylinder 172 is maintained at the predefined pressure by hydraulic fluid remaining within the first chamber 188, thereby enabling smooth engagement of the vehicle 116 with the machine 100. Further, the stopping members 199 may prevent movement of the first and the second rollers 134, 144 beyond the second position 'P2'. Thus, the actuating member 160 and the hydraulic system 192 may be prevented from damage due to an accidental heavy load caused by the vehicle 116 during engagement with the machine 100.

The system 130 and the associated hydraulic system 192 may have a simple and cost effective design without requiring multiple mechanical linkages and components. Further, resetting of the system 130 may be accomplished by the hydraulic system 192 without requiring any additional electronic control system.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A system for absorbing impact load in a machine, the impact load is caused by a vehicle, the system comprising:

a first frame adapted to support a first roller, the first roller configured to abut a first set of ground engaging members of the vehicle;

a second frame adapted to support a second roller, the second roller configured to abut a second set of ground engaging members of the vehicle;

a pin member configured to couple the first frame and the second frame, the first frame and the second frame configured to be moveable relative to each other about a rotating axis defined by the pin member; and an actuating member coupled between the first frame and the second frame, the actuating member configured to move the first frame and the second frame about the pin member.

2. The system of claim 1, wherein the first frame comprising:

an elongate body having a first end adapted to support the first roller and a second end distal from the first end, the second end comprises a through hole defined along the rotating axis configured to at least partly receive the pin member; and a first arm disposed adjacent to the second end of the elongate body to couple with the actuating member.

3. The system of claim 2, wherein the second frame comprising:

a second elongate body having a first end adapted to support the second roller and a second end distal from the first end, the second end comprises a second through hole defined along the rotating axis configured to at least partly receive the pin member; and a second arm disposed adjacent to the second end of the second elongate body to couple with the actuating member.

4. The system of claim 3, wherein the actuating member comprising:

a cylinder having a head end coupled to one of the first arm and the second arm; and a plunger slidably received within the cylinder through a rod end thereof, the plunger having a free end coupled to one of the first arm and the second arm, wherein the plunger is configured to be movable between an extended position and a retracted position to move the first frame and the second frame about the pin member.

5. The system of claim 1, wherein the actuating member is a hydraulic actuator.

6. The system of claim 5, wherein the actuating member is configured to be in fluid communication with a hydraulic system of the machine, the hydraulic system comprises an accumulator, the accumulator configured to selectively supply hydraulic fluid to the actuating member.

7. The system of claim 5, wherein the actuating member is a single acting cylinder.

8. A machine comprising:

a chassis; and a system associated with the chassis, the system configured to absorb impact load caused by a vehicle, the system comprising:

a first frame adapted to support a first roller, the first roller configured to abut a first set of ground engaging members of the vehicle;

a second frame adapted to support a second roller, the second roller configured to abut a second set of ground engaging members of the vehicle;

a pin member configured to couple the first frame and the second frame, the first frame and the second frame configured to be moveable relative to each other about a rotating axis defined by the pin member, wherein the pin member is coupled to the chassis of the machine; and an actuating member coupled between the first frame and the second frame, the actuating member configured to move the first frame and the second frame about the pin member.

9. The machine of claim 8, wherein the first frame comprising:

an elongate body having a first end adapted to support the first roller and a second end distal from the first end, the second end comprises a through hole defined along the rotating axis configured to at least partly receive the pin member; and a first arm disposed adjacent to the second end of the elongate body to couple with the actuating member.

10. The machine of claim 9, wherein the second frame comprising:

a second elongate body having a first end adapted to support the second roller and a second end distal from the first end, the second end comprises a second through hole defined along the rotating axis configured to at least partly receive the pin member; and a second arm disposed adjacent to the second end of the second elongate body to couple with the actuating member.

11. The machine of claim 10, wherein the chassis comprising:

a first support member having a first aperture defined along the rotating axis, the first aperture configured to at least partly receive the pin member therethrough; and a second support member distal from the first support member, the second support member having a second aperture defined along the rotating axis, the second aperture configured to at least partly receive the pin member therethrough;

wherein the first support member and the second support member are configured to receive the second ends of the first frame and the second frame therebetween and couple the first frame and the second frame via the pin member.

12. The machine of claim 10, wherein the actuating member comprising:

a cylinder having a head end coupled to one of the first arm and the second arm; and a plunger slidably received within the cylinder through a rod end thereof, the plunger having a free end coupled to one of the first arm and the second arm, wherein the plunger is configured to be movable between an extended position and a retracted position to move the first frame and the second frame about the pin member.

13. The machine of claim 10, wherein the actuating member is a hydraulic actuator.

14. The machine of claim 13, wherein the actuating member is configured to be in fluid communication with a hydraulic system of the machine.

15. The machine of claim 14, wherein the hydraulic system comprises an accumulator, the accumulator configured to be in fluid communication with the actuating member, and wherein the accumulator is further configured to selectively supply hydraulic fluid to the actuating member for moving the first arm and the second arm about the pin member.

16. The machine of claim 13, wherein the actuating member is a single acting cylinder.

17. A system for absorbing impact load in a machine, the impact load is caused by a vehicle, the system comprising:

a first frame having a first end adapted to support a first roller, the first roller configured to abut a first set of ground engaging members of the vehicle, wherein the first frame comprises a first arm at a second end thereof, the second end is distal from the first end;

a second frame adapted to support a second roller, the second roller configured to abut a second set of ground engaging members of the vehicle, wherein the second frame comprises a second arm at a second end thereof, the second end is distal from the first end;

a pin member configured to couple the second ends of the first frame and the second frame, wherein the first frame and the second frame are configured to be moveable relative to each other about a rotating axis defined by the pin member; and an actuating member configured to move the first frame and the second frame about the pin member, the actuating member comprising:

a cylinder having a head end coupled to one of the first arm and the second arm; and a plunger slidably received within the cylinder through a rod end thereof, the plunger having a free end coupled to one of the first arm and the second arm, wherein the plunger is configured to be movable between an extended position and a retracted position to move the first frame and the second frame about the pin member.

18. The system of claim 17, wherein the actuating member is a hydraulic actuator.

19. The system of claim 18, wherein the actuating member is configured to be in fluid communication with a hydraulic system of the machine, the hydraulic system comprises an accumulator, the accumulator configured to selectively supply hydraulic fluid to the actuating member.

20. The system of claim 18, wherein the actuating member is a single acting cylinder.

* * * * *